US012529329B2

(12) United States Patent
Radulescu et al.

(10) Patent No.: US 12,529,329 B2
(45) Date of Patent: Jan. 20, 2026

(54) COMBINATIONS AND SUB COMBINATIONS OF VALVETRAIN ASSEMBLIES

(71) Applicant: Eaton Intelligent Power Limited, Dublin (IE)

(72) Inventors: Andrei Dan Radulescu, Marshall, MI (US); Swapnil Jarande, Maharashtra (IN); Saurabh Patil, Maharashtra (IN); Jeffrey R. Brown, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 45 days.

(21) Appl. No.: 18/802,636

(22) Filed: Aug. 13, 2024

(65) Prior Publication Data

US 2024/0401507 A1 Dec. 5, 2024

Related U.S. Application Data

(63) Continuation of application No. PCT/EP2023/025122, filed on Mar. 17, 2023.

(30) Foreign Application Priority Data

Mar. 17, 2022 (IN) ..... 202211014739
Jun. 30, 2022 (IN) ..... 202211037655

(51) Int. Cl.
*F01L 1/26* (2006.01)
*F01L 1/46* (2006.01)
(Continued)

(52) U.S. Cl.
CPC ..... *F01L 1/26* (2013.01); *F01L 1/46* (2013.01); *F01L 1/146* (2013.01); *F01L 1/181* (2013.01);
(Continued)

(58) Field of Classification Search
CPC ..... F01L 1/146; F01L 1/181; F01L 2001/187; F01L 1/26; F01L 1/46; F01L 2001/467;
(Continued)

(56) References Cited

U.S. PATENT DOCUMENTS 4,864,983 A * 9/1989 Breitbarth ..... F01L 1/46 123/90.61
6,047,675 A * 4/2000 Kunz ..... F01L 1/46 123/90.43
(Continued)

FOREIGN PATENT DOCUMENTS

WO WO 2021226636 A1 11/2021

OTHER PUBLICATIONS

International Search Report and Written Opinion for International Application No. PCT/EP2023/025122 mailed on Jun. 20, 2023, 16 pages.

*Primary Examiner* — Mark A Laurenzi
*Assistant Examiner* — Kelsey L Stanek
(74) *Attorney, Agent, or Firm* — Baker Botts L.L.P.

(57) ABSTRACT

In one embodiment, a retention feature for use in a valvetrain assembly is configured to be attached to a valve bridge and connect the valve bridge with at least one of a rocker arm and a first engine valve of at least two engine valves. The retention feature is further configured to maintain a position of the valve bridge to be aligned with at least two engine valves and resist separation of the valve bridge from at least two engine valves during uncontrolled valve bridge movement. In other embodiments, the valvetrain assembly further includes a mechanical stopper which is disposed on an upper surface of a rocker arm carrier and configured to contact against a lower surface of the rocker arm during uncontrolled valve bridge movement.

20 Claims, 9 Drawing Sheets

(51) Int. Cl.
*F01L 1/14* (2006.01)
*F01L 1/18* (2006.01)
*F01L 13/00* (2006.01)

(52) U.S. Cl.
CPC ... *F01L 2001/187* (2013.01); *F01L 2001/467* (2013.01); *F01L 13/0005* (2013.01)

(58) Field of Classification Search
CPC ... F01L 13/0005; F01L 1/187; F01L 2820/01; F01L 2305/00
USPC ..... 123/90.4, 90.61, 90.66
See application file for complete search history.

(56) References Cited

U.S. PATENT DOCUMENTS 7,878,166 B2 * 2/2011 Wotherspoon ..... F01L 3/10 123/90.39
10,883,392 B2 1/2021 Gron
2002/0017253 A1 * 2/2002 Danesh ..... F01L 1/182 123/90.4
2006/0075979 A1 * 4/2006 Grant ..... F01L 1/26 123/90.4
2007/0006835 A1 * 1/2007 Decuir ..... F01L 1/30 123/90.24
2009/0139477 A1 * 6/2009 Wotherspoon ..... F01L 3/10 123/90.22
2011/0220051 A1 * 9/2011 Wotherspoon ..... F01L 1/181 123/90.39
2013/0098319 A1 * 4/2013 Methley ..... F01L 1/26 123/90.12
2015/0159520 A1 * 6/2015 Cecur ..... F01L 1/25 123/90.12
2018/0094553 A1 * 4/2018 Nair ..... F01L 1/2411
2019/0277170 A1 9/2019 Mandell
2020/0263571 A1 * 8/2020 Benn ..... F01L 1/267
2020/0355094 A1 11/2020 Mitchum

* cited by examiner

COMBINATIONS AND SUB COMBINATIONS OF VALVETRAIN ASSEMBLIES

PRIORITY

This application claims the benefit under 35 U.S.C. § 365 (c) of International Patent Application No. PCT/EP/2023/025122, filed 17 Mar. 2023, which claims the benefit under 35 U.S.C. § 119 (a) of Indian Provisional Application No. 202211014739, filed 17 Mar. 2022, and Indian Provisional Application No. 202211037655, filed 30 Jun. 2022, all of which are incorporated herein by reference.

TECHNICAL FIELD

This disclosure generally relates to valve system, and more particularly to combinations and sub combinations of valvetrain assemblies for use with internal combustion engine that is suitable for providing cylinder deactivation functionality.

BACKGROUND

Various valve system designs have been produced in the past for use in connection with internal combustion engine. Generally, such valve system is coupled to a typical camshaft on one side and to an engine cylinder on the other side in a way for delivering actuation motion from the camshaft to downstream valves located in the cylinder. For multi-cylinder engine configured with cylinder deactivation technique, that is, selected cylinder combination may be disabled by deactivating the valves in those cylinders for the purpose of adjusting engine and/or fuel efficiency on demand, problems associated with motion transmission for valve actuation may often occur. Typically, in a valve system constructed to achieve such cylinder deactivation, mechanical switching components (e.g., locking mechanism) are usually employed, which, in operation, may rapidly shift the system from activation mode (i.e., valve actuation motion provided by the camshaft is allowed to be delivered to the cylinder) to deactivation mode (e.g., motion originated from the camshaft is absorbed by the mechanical switching components, thus the respective valve is unactuated), or vice versa as needed. However, there exists possibility for unexpected mechanical switching to occur during lift event of the valve system, in which the valve is on lift and suddenly the switching mechanism turns the system to lift off. In this case, when the system suddenly shifts from activation to deactivation mode, force provided by actuation motion for driving the valve to open is removed, consequently causing the valve to rapidly return to a closed position until it hits against the valve seat (e.g., as a result of biasing force by valve spring). As used herein, this type of switching scenario is referred to as "critical shift" event of the valve system or uncontrolled valve motion. When critical shift happens, momentum generated by the valve movement and sudden stop of the valve on the valve seat continue to affect a valve bridge that is placed on top of the valve, thereby separating the bridge from the valve in a generally upward direction away from the valve in an uncontrolled way. Furthermore, when the valve bridge lands back, for example, due to gravity, it is possible that the valve bridge may not be able to reposition itself into proper alignment or engagement with the valve, thereby causing separation or dislodgement of the valve bridge from terminal end of the valve. Separation can also occur at an interface between the rocker arm and a push tube. Collapsing of the mechanical switching components and differences in the moment of inertia between the rocker arm and the push tube and/or between the push tube and a socket for receiving the push tube can create separations between the push tube and the rocker arm and, in particular, between the push tube and the receiving socket. That separation if occurs must not allow for the push tube to lose overlap with the rocker arm and the socket.

Accordingly, there is a need to provide a solution that prevents or at least mitigates such undesirable dynamic behavior of the system due to critical shift event.

SUMMARY OF PARTICULAR EMBODIMENTS

The disclosure presents various components and combinations of components of a valvetrain assembly that help to avoid bridge dislodgement during a critical shift event, thereby allowing the valvetrain assembly to deliver proper valve lift and maintain its desired function.

In one embodiment, a valvetrain assembly comprises a rocker arm carrier, a rocker arm rotatably supported by the rocker arm carrier, at least two engine valves comprising at least a first engine valve and a second engine valve, a valve bridge spanning the at least two engine valves and connected between the at least two engine valves and one end of the rocker arm, a switching mechanism operatively coupled to the rocker arm and including a first body and a second body which are configured for relative movement with respect to each other, and a retention feature. In particular, the retention feature is configured to be attached to the valve bridge and connect the valve bridge with at least one of the rocker arm and the first engine valve of the at least two engine valves. Moreover, the retention feature is further configured to maintain a position of the valve bridge to be aligned with the at least two engine valves and resist separation of the valve bridge from the at least two engine valves during uncontrolled valve bridge movement.

In particular embodiments, the retention feature comprises at least one clip which is configured to be removably attached to the valve bridge and engage with at least the first engine valve of the at least two engine valves. In particular embodiments, the clip comprises at least one opening which is arranged at a base of the clip and configured to allow an end portion of at least the first engine valve to be inserted through the opening. In particular embodiments, the at least one opening has an inner diameter which is dimensioned such that the end portion of the first engine valve, when inserted through the at least one opening, forms friction fit with the retention feature. In particular embodiments, the retention feature further comprises a push nut which is configured to be positioned on top of the at least one opening. In particular embodiments, the clip comprises two openings which are arranged near opposite ends of the base of the clip and configured to allow end portions of the first engine valve and the second engine valve to be respectively inserted through the two openings. In particular embodiments, the clip comprises at least two retention legs which are configured to hold an end portion of at least the first engine valve therebetween. In particular embodiments, the retention feature comprises at least two protrusions formed on a top surface of the valve bridge. The at least two protrusions are configured to define a spacing therebetween suitable for receiving at least a portion of the rocker arm. In particular embodiments, the retention feature further comprises a pin that is configured to extend through the at least two protrusions and the portion of the rocker arm such that the valve bridge is rotatably connected to the rocker arm.

In particular embodiments, the valvetrain assembly further comprises a mechanical stopper which is disposed on an upper surface of the rocker arm carrier and configured to contact against a lower surface of the rocker arm during uncontrolled valve bridge movement. In particular embodiments, the mechanical stopper is configured to protrude from the upper surface of the rocker arm carrier towards the lower surface of the rocker arm. In particular embodiments, the mechanical stopper is formed integrally with the rocker arm carrier.

In particular embodiments, the valvetrain assembly further comprises a stopper feature which is disposed on the lower surface of the rocker arm and configured to contact against the mechanical stopper during uncontrolled valve bridge movement. In particular embodiments, the valvetrain assembly further comprises a spring which is configured to be connected to the switching mechanism and damp relative movement between the first body and the second body of the switching mechanism. In particular embodiments, the spring has a stiffness increased by approximately 50% and a preload increased by approximately 230% to reduce moment of inertia of the bridge and minimize separation between the valves and the bridge. In particular embodiments, the spring has a stiffness about 15 N/mm and a preload about 470 N. In particular embodiments, the valvetrain assembly further comprises a gap which is positioned between the first body and the second body of the switching mechanism and configured to define landing of the second body with respective to the first body without damaging the first body. In particular embodiments, the gap has a height about 7.98 mm. In particular embodiments, the valvetrain assembly further comprises at least two receptacles positioned on a lower surface of the valve bridge and configured to respectively receive at least a portion of the at least two engine valves. The at least two receptacles have a depth that is increased to maintain overlap between the bridge and the valve stem in the event of partial separation of the bridge from the valve top surfaces. In particular embodiments, the at least two receptacles have a depth about 6 mm. In particular embodiments, the valvetrain assembly further comprises a socket positioned on a lower surface at another end of the rocker arm. The socket has a depth that is increased to maintain overlap between the push tube and the rocker arm in the event of critical shift. The amount of overlap is optimized by using engine simulations in critical shift. Similar optimization is possible when performing physical tests and observing or measuring the bridge uncontrolled movements. In particular embodiment, the socket has a depth of 7.5 mm.

In one embodiment, a valvetrain assembly comprises a rocker arm carrier, a rocker arm rotatably supported by the rocker arm carrier, at least two engine valves comprising at least a first engine valve and a second engine valve, a valve bridge spanning the at least two engine valves and connected between the at least two engine valves and one end of the rocker arm, a switching mechanism operatively coupled to the rocker arm and including a first body and a second body which are configured for relative movement with respect to each other, and a spring which is configured to be connected to the switching mechanism and damp relative movement between the first body and the second body of the switching mechanism. The spring has an increased stiffness and preload such that the valve bridge is caused to maintain contact with the at least two engine valves during uncontrolled valve bridge movement.

In particular embodiment, the valvetrain assembly further comprises a retention feature configured to be attached to the valve bridge and connect the valve bridge with at least one of the rocker arm and the first engine valve of the at least two engine valves.

In one embodiment, a valvetrain assembly comprises a rocker arm carrier, a rocker arm rotatably supported by the rocker arm carrier, at least two engine valves comprising at least a first engine valve and a second engine valve, a valve bridge spanning the at least two engine valves and connected between the at least two engine valves and one end of the rocker arm, a switching mechanism operatively coupled to the rocker arm and including a first body and a second body which are configured for relative movement with respect to each other, a socket positioned on a lower surface at another end of the rocker arm and configured to receive a push rod, and a mechanical stopper which is disposed on an upper surface of the rocker arm carrier and configured to contact against a lower surface of the rocker arm during uncontrolled valve bridge movement. The socket has a depth that prevents the push rod from separating from the socket during uncontrolled valve bridge movement. The socket and the mechanical stopper are configured to limit motion of the rocker arm and prevent the valve bridge from separating from the at least two engine valves during uncontrolled valve bridge movement.

BRIEF DESCRIPTION OF THE DRAWINGS

Embodiments in accordance with this disclosure will now be described by reference to the accompanying drawings, in which.

DESCRIPTION OF EXAMPLE EMBODIMENTS

Figure 1:
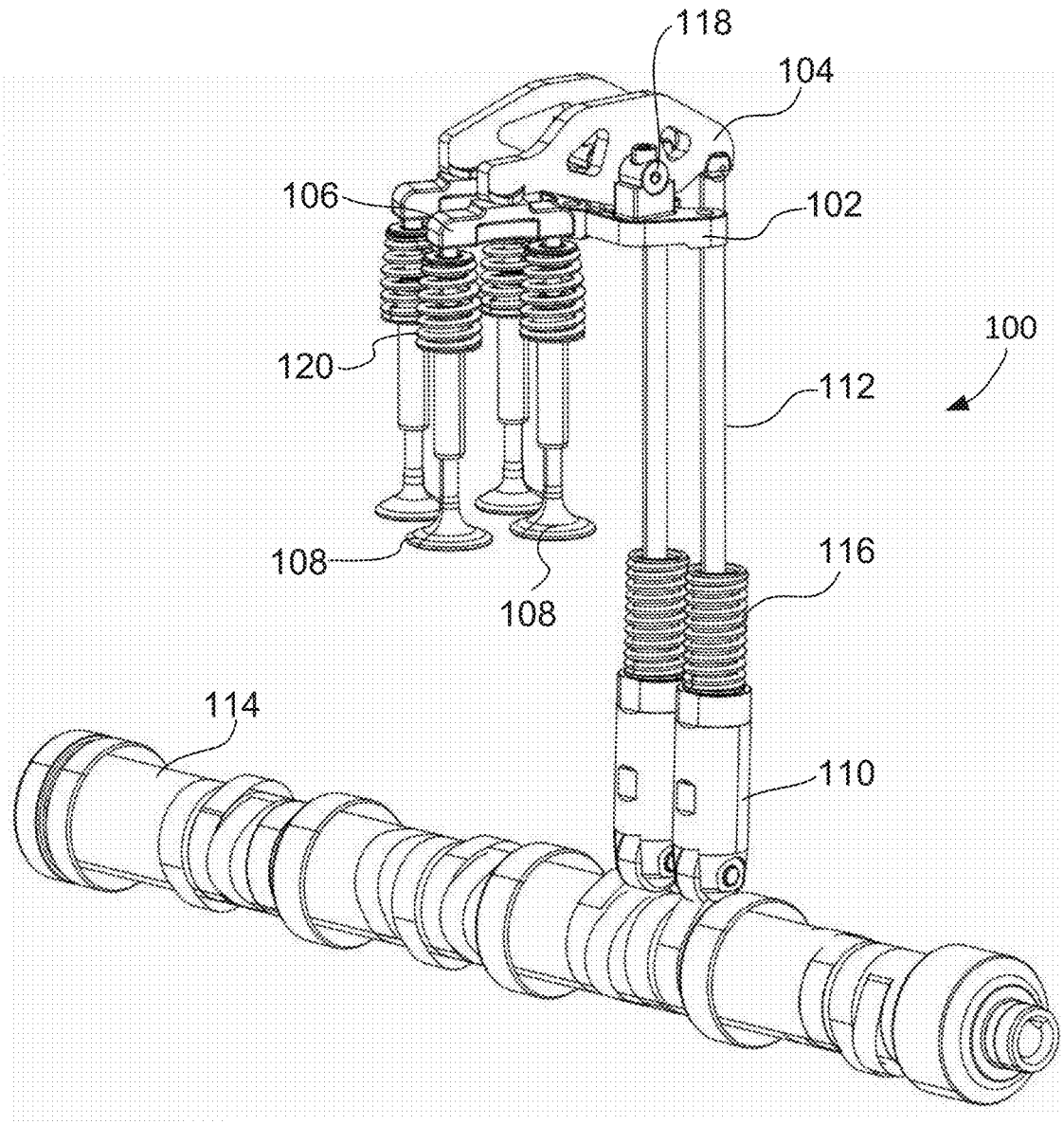
FIG. 1 depicts an embodiment of an overall valvetrain assembly according to this disclosure, which is employed in connection with a typical camshaft known in the art.

FIG. 1 illustrates an example valvetrain assembly 100 in accordance with this disclosure, which may be used in connection with an internal combustion engine in a manner generally known in the art. In practice, a pair of valvetrain assemblies may be provided for each engine cylinder for performing intake and exhaust operation, respectively. However, for sake of simplicity of this disclosure, the following is described with reference to one valvetrain assembly 100, which is shown at the front in FIG. 1.

In the illustrated embodiment, the valvetrain assembly 100 comprises a roller lifter 110 that may ride, at base portion thereof, on a typical camshaft 114 and is configured to reciprocate in a vertical direction in a controllable manner (details of which will be explained below with reference to FIG. 2) upon actuation by camshaft rotation. As shown, upper portion of the roller lifter 110 may receive and be coupled to lower end of a push rod 112, while upper end of the push rod 112 may in turn engage with a rocker arm 104 in such a way to allow vertical displacement of the roller lifter 110 (e.g., by rotation of the camshaft 114) to be conveyed through the push rod 112 to the rocker arm 104, thereby causing the rocker arm 104 to rotate as needed. The rocker arm 104 is further shown to be supported on a rocker arm carrier 102 by means of a rocker shaft 118 in a manner that enables relative rotation of the rocker arm 104 around the rocker shaft 118. As an example and not by way of limitation, the rocker arm carrier 102 may be mechanically mounted to a cylinder head (not shown) of the internal combustion engine, e.g., via mounting bolts or other suitable fasteners. In particular embodiments, the rocker arm 104 is further operatively coupled to a valve bridge 106, which is configured to sit atop and receive terminal ends of typical engine valves 108. In the embodiment of FIG. 1, the valve bridge 106 is depicted as extending between and accommodating two valve tips, nevertheless it is contemplated by this disclosure that the valve bridge may be adapted for engagement with any desired number of engine valves. Configured in this way, rotational motion of the rocker arm 104—for example, in a counterclockwise direction as shown in FIG. 1—may push down the valve bridge 106 and therefore actuate the valves 108 connected downstream thereto to an open position, i.e., away from corresponding valve seats (not shown) located in the cylinder head. Conversely, when no actuation motion is applied (e.g., in this case, the roller lifter 110 may be at its lower position, or the valvetrain assembly 100 is otherwise deactivated), a biasing force provided by a valve spring 120 in an upward direction may urge the valve 108 to a closed position and press tight against the valve seat. Though described in such a manner, it is understood that the valvetrain assembly as presented above is merely a non-limiting example. Other suitable components or assemblies associated with a typical valve system may also be provided as familiar to those skilled in the art for achieving the desired function.

Figure 2:
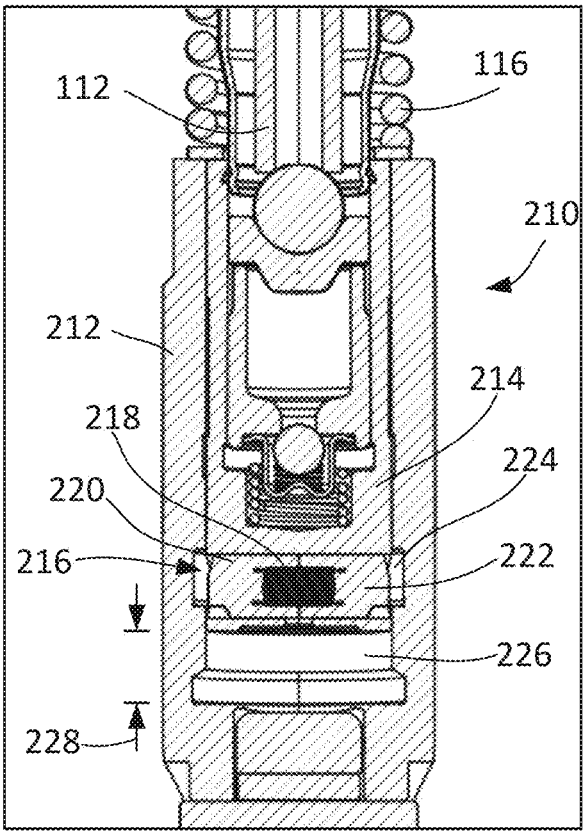
FIG. 2 depicts a cross-sectional view of base portion of a roller lifter according to this disclosure, particularly showing various components for facilitating cylinder deactivation functionality.

In particular embodiments, the valvetrain assembly 100 may be configured for providing so-called cylinder deactivation functionalities, i.e., a chosen combination of cylinders is systematically disabled, for example, for better fuel economy or overall engine efficiency such that the system may operate on fewer cylinders when less power output is demanded. To this end, the valvetrain assembly, for example, the roller lifter, may be provided with various lost motion components that may disable motion transfer from the camshaft to the engine valves, i.e., in doing so, motion on the selected cylinder is consequently "lost". FIG. 2 illustrates an embodiment of a roller lifter 210 which may be suitable for performing cylinder deactivation. As a non-limiting example, in order to enable such function, base portion of the roller lifter 210 may be provided with a switching mechanism that selectively switches its motion components between a lock mode (e.g., in a fixed relationship) and a unlock mode (i.e., moveable with respect to each other) based on need. For example, in the embodiment as depicted in FIG. 2, the switching mechanism may comprise an outer body 212 and an inner body 214 positioned within the outer body 212 and configured to be able to travel vertically relative to the outer body 212 as demanded. More specifically, a collapsible latch 216 can be disposed inside the inner body 214 and is designed to mechanically switch during camshaft rotation. As an example and not by way of limitation, the collapsible latch 216 may include two latch pins 220, 222 and a latch spring 218 connected therebetween. In operation, the inner body 214 is fixed with respect to the outer body 212 in the default position where biasing force applied by the latch spring 218 pushes the two latch pins 220, 222 outwards to a position beyond outer boundary of the inner body 214 and further into a recess 224 formed on interior wall of the outer body 212. In this way, the inner body 214 is locked tight to the outer body 212 by the collapsible latch 216 in extended state, thus forming a single unit that, as a whole, permits motion to be conveyed through the switching mechanism to the push rod 112, the rocker arm 104, and eventually to the engine valves 108. Conversely, for example, when cylinder deactivation is needed, the latch pins 220, 222 may be retracted, e.g., by means of fluid pressure, out of engagement with the recess 224 until they are well contained within the inner body 214. The inner body 214 in this scenario as depicted in FIG. 2 is allowed to move freely along the vertical direction inside the outer body 212, such that any valve actuation motion applied to the outer body 212 (e.g., by the camshaft) may be absorbed by the up-and-down displacement between the inner body 214 and the outer body 212. When switching back to lift mode, the latch spring 218 will bias the two latch pins 220, 222 outward and return to the latched position.

Again, it will be appreciated that the switching mechanism described herein is merely exemplary, and not intended to limit the scope of this disclosure. Although the above explains operation of the switching mechanism by referencing to particular components, these components are provided for illustration purposes only and are not necessarily a requirement. Other suitable configurations of the switching mechanism may be apparent to those skilled in the art and are not explained in exhaustive details by this disclosure. For example, in some embodiments, the switching mechanism may alternatively be positioned on the push rod at a location in proximity to the rocker arm and distant from the roller lifter.

For valvetrain system employing a switching mechanism of such type, critical shift may happen if mechanical switching occurs during lift event (i.e., where the engine valve is actuated by camshaft rotation to an open position) especially if there exists weak engagement in the switching mechanism (for example, this may be the case when the latch pins minimally interface with the outer body). In this case, for example, the switching mechanism may suddenly yield under increased system loading, thus rapidly shifting the roller lifter connected thereto from a partially locked state to an unlocked state and consequently breaking motion and force transmission from the camshaft to the engine valve. Because actuation force that may otherwise be applied to the valve and oppose against valve spring force has been eliminated, the valve is allowed to shoot up until it eventually hits the valve seat. Thereafter, remaining momentum will continue to act upon the valve bridge, the rocker arm, and the push rod, consequently throwing the valve bridge in an uncontrolled fashion away from the valve to the extent that the valve bridge is separated or dislodged from the corresponding valve end. In this case, when the valve bridge falls back under gravity, it may no longer be in proper alignment with the valve tip, thus resulting in malfunction or failure of the entire valvetrain assembly. This phenomenon is also known as bridge separation or dislodgement.

Figure 15:
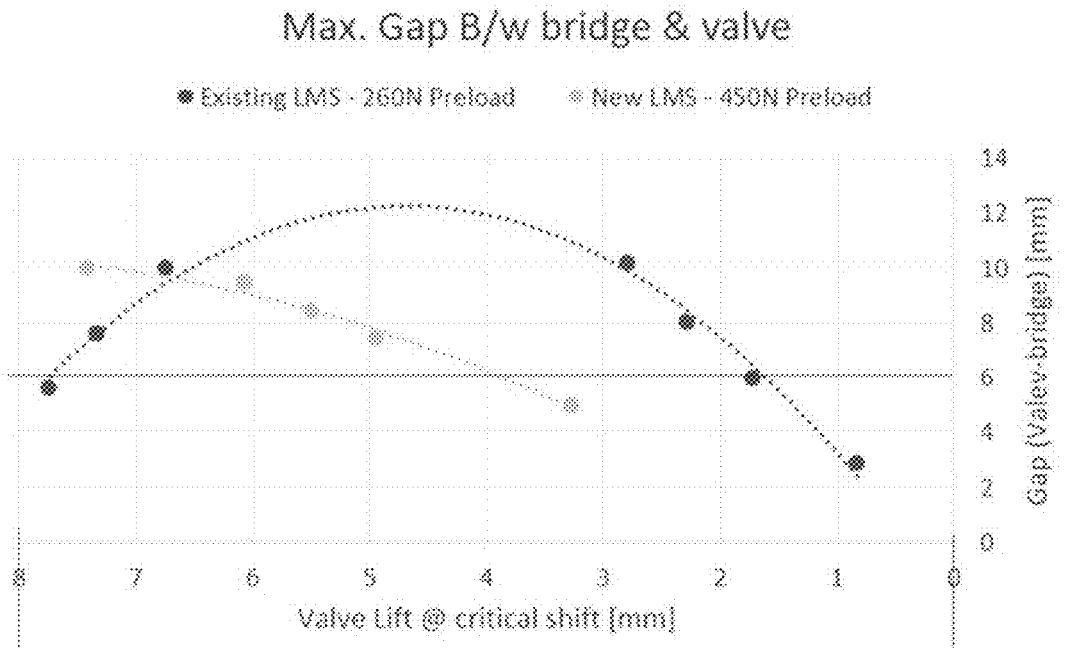
FIG. 15 depicts an example relation between spring load and separation of a valve bridge from a valve of an embodiment of a lost motion spring according to this disclosure as compared to a conventional spring configuration.

In order to minimize such dislodgement and maintain system dynamics of the valvetrain assembly in a controlled state, in the embodiment as depicted in FIG. 2, the valvetrain assembly is further provided with a lost motion spring 116, which may be coupled to the switching mechanism housed inside the roller lifter 210 and the push rod 112 for allowing motion dampening in a critical shift event. In particular embodiments, it may be advantageous to maximize stiffness and preload of the lost motion spring 116 so as to mitigate separation during critical shift. In one embodiment, the spring has a stiffness increased by approximately 50% and a preload increased by approximately 230% to reduce moment of inertia of the bridge and minimize separation between the valves and the bridge. In another embodiment, the lost motion spring 116 may have an increased stiffness and preload around 15 N/mm and 470 N, respectively. Of course, it will be understood that these values are limited by other design constraints such as packaging, spring life, etc. Such perimeters may provide benefits in resisting valve bridge separation and are preferable over typical configuration of a spring having for example an original spring stiffness and preload of 10 N/mm and 206 N. FIG. 15 illustrates an example relation between spring load and separation of the valve bridge from the valve. It can be observed that the lost motion spring configured according to this disclosure mitigate bridge separation by a considerable amount as compared to the original spring. In this way, in case of a critical shift where motion transmission to the valve breaks off and the valve spring thus acts free of any actuation force that may otherwise be applied to compress the valve spring, the lost motion spring 116 may advantageously provide a considerable opposing force (e.g., upwards in the vertical direction as shown) counter-acting the valve spring force as well as resisting undesired dynamic behavior of other movable components of the valvetrain assembly (e.g., due to inertia), so as to mitigate separation of the valve bridge and facilitate control of overall system dynamics.

Additionally or alternatively, as further illustrated in FIG. 2, in particular embodiments, a lost motion gap 226 may be provided between bottom surface of the inner body 214 and base portion of the outer body 212. In particular embodiments, depth 228 of the lost motion gap 226 may be measured at zero lift condition when the cam is on base circle (as shown in FIG. 2). As compared to a conventional switching mechanism which typically comprises a gap having depth about 9.10 mm, the depth 228 of the lost motion gap 226 may advantageously be reduced, for example, to about 7.98 mm. Provided as such, the lost motion gap 226 may form a defined landing for the inner body 214 in a way that, when the inner body 214 is in an unlocked state—i.e., permitted to travel vertically inside the outer body 212 either as needed or due to unexpected switching-downward displacement thereof is effectively restrained to a degree defined by the depth 228 of the lost motion gap 226.

Figure 3:
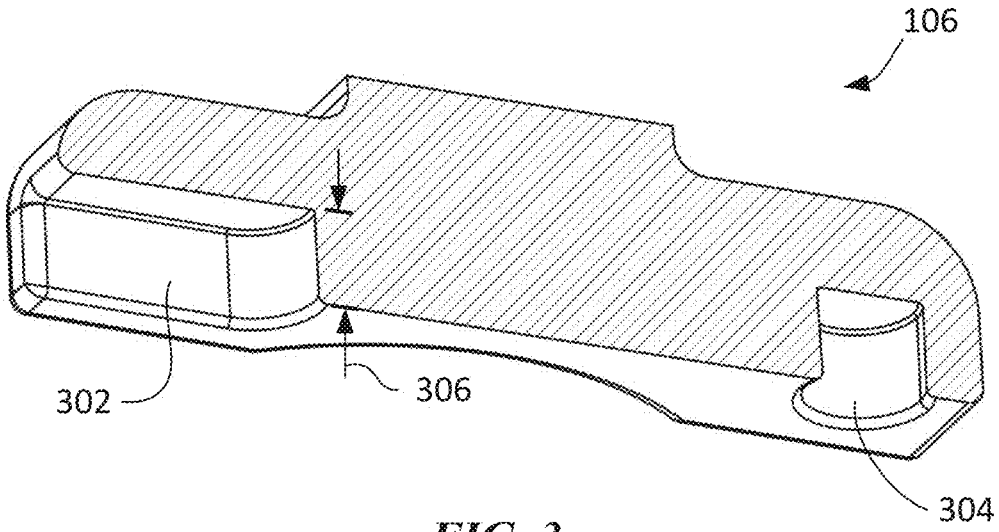
FIG. 3 depicts a cross-sectional view of an embodiment of a valve bridge according to this disclosure.

FIG. 3 illustrates a cross-sectional view of an example valve bridge 106 according to this disclosure, which comprises two receptacles 302, 304 at bottom surface of the valve bridge 106. As depicted, in particular embodiments, the two receptacles 302, 304 are respectively arranged near opposite ends of the valve bridge 106 in such a position that when the valve bridge 106 sits on top of the engine valves 108 (shown in FIG. 1), the receptacles 302, 304 are in line with corresponding tips of the valves 108. As an example and not by way of limitation, the receptacles 302, 304 may be configured to have a longitudinal depth 306 that is suitable for receiving portions of the terminal ends of the valves and capable of facilitating the end portions to be at least partially contained within the receptacles 302, 304 even when the valvetrain assembly experiences a critical shift. In particular embodiments, it may be desirable to maximize the depth 306 of the receptacles 302, 304 in order to mitigate separation between the valve bridge 106 and the valves 108. As an example and not by way of limitation, the depth 306 of the receptacles 302, 304 may be defined to maintain an overlap between the valves 108 and the valve bridge 106 in the event of bridge uncontrolled motion during critical shift. In a non-limiting example, maximum depth of the receptacles 302, 304 may be about 6 mm, which is limited by other design constraints such as packaging, fatigue life, mass, etc. Such depth may advantageously permit special redundancy for housing the valve ends in a manner that in case of a critical shift event where the valve bridge may eject upwards away from the valves, the depth of the receptacles may still be sufficient to enable the valve bridge 106 to maintain minimal level of engagement with tips of the valves, thereby preventing the valve bridge 106 from dislodging from the valves entirely. As further depicted in FIG. 3, the receptacle 302 moreover comprises a lateral opening which, for example, may be suitable for assisting position and/or reposition of the valve bridge 106 onto the valve tip. Though illustrated as such, this configuration is not necessarily required. Other suitable shapes of the receptacles are possible as well.

Figure 4:
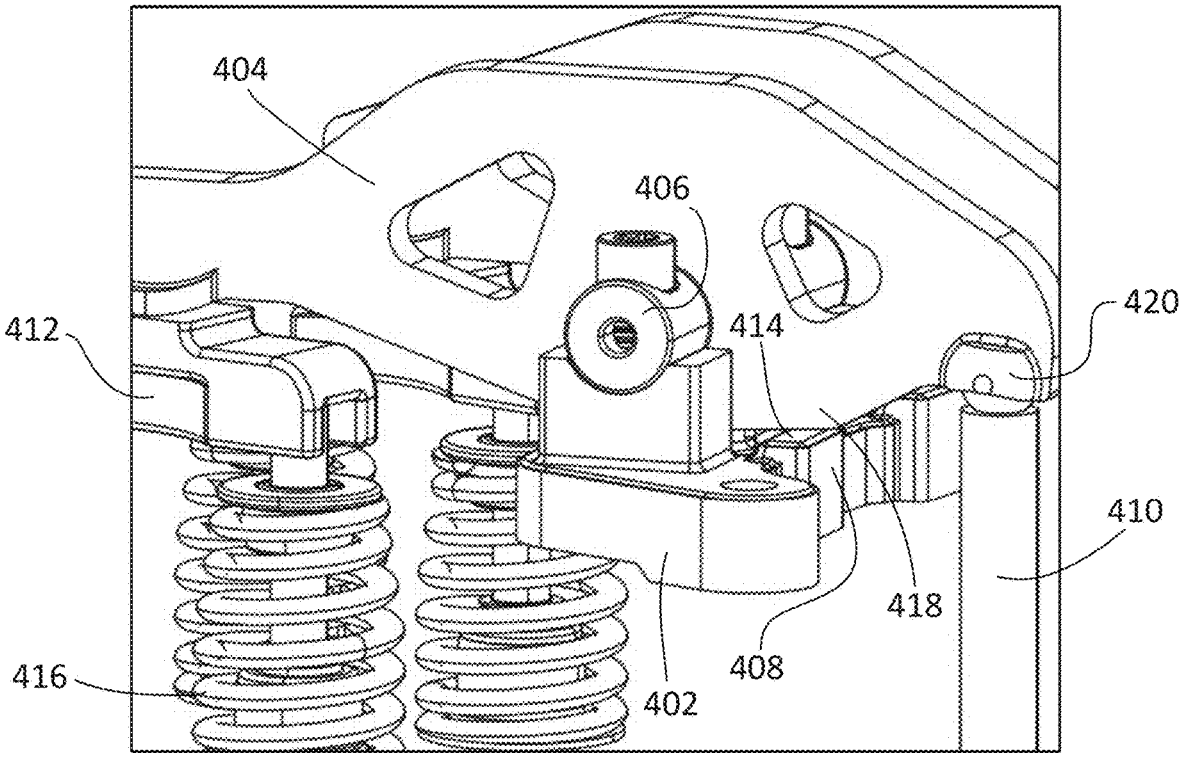
FIG. 4 depicts a partial view on portions of a valvetrain assembly according to this disclosure, specifically illustrating components associated with a rocker arm carrier and a rocker arm of the valvetrain assembly.
Figure 5:
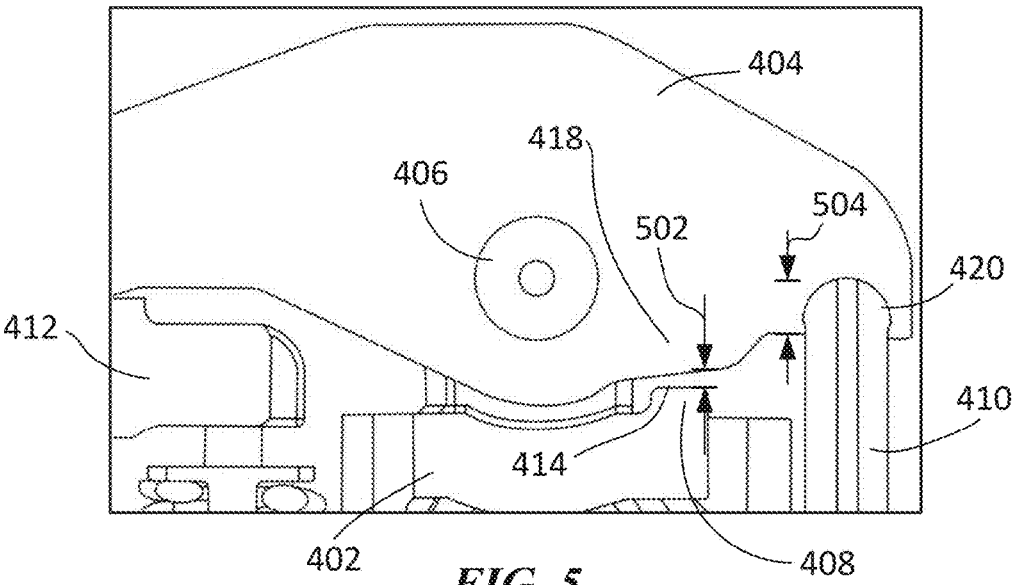
FIG. 5 depicts a side view of the illustration of the rocker arm carrier and the rocker arm in FIG. 4.

FIGS. 4 and 5 are respective isometric and cross-sectional views of an example valvetrain assembly in accordance with this disclosure, in particular delineating a rocker arm 404 and a rocker arm carrier 402 that supports the rocker arm 404 in a vertical direction and at the same time allows the rocker arm 404 to rotate relative to the rocker arm carrier 402. In particular embodiments, as illustrated in FIG. 4, a rocker shaft 406 may be rigidly fixed on an upper surface of the rocker arm carrier 402 and configured to extend through a through hole provided near center portion of the rocker arm 404 so as to permit rotation of the rocker arm 404 around the rocker shaft 406 in a known manner in the art. As further shown in FIG. 4, in particular embodiments, a mechanical stopper 408 may be provided, which is disposed on the upper surface of the rocker arm carrier 402 and positioned in vicinity to end portion of the rocker arm 404 that is attached to the push rod 410 and distant from opposite end of the rocker arm 404 that is associated with the valve bridge 412. As an example and not by way of limitation, the mechanical stopper 408 may be designed as a block protruding upwards from the upper surface of the rocker arm carrier 402 towards bottom surface of the rocker arm 404. As a further non-limiting example, the mechanical stopper 408 may be formed integrally with the rocker arm carrier 402, or separately if needed. Although described in this particular manner, it will be appreciated that the mechanical stopper 408 of this disclosure may take form as other suitable shapes or configurations, for example, a pin, a tab, a nob, an insert, or other mechanical features which can be permanently or detachably mounted to the rocker arm carrier 402 for performing desired function of this disclosure. Further, in particular embodiments, the mechanical stopper 408 may comprise a generally horizontal stop surface 414 that is located proximately to and facing bottom surface of the rocker arm 404. Though in proximity, the stop surface 414 is configured in such a position that, during normal cylinder operation, when the rocker arm 404 is caused to rotate back and forth so as to enable opening and closing of the engine valves, the stop surface 414 avoids contact with bottom surface of the rocker arm 404 and consequently does not interfere with the controlled rotational movement of the rocker arm 404. However, in the event of critical shift, during which the rocker arm 404 is urged, for example under biasing force of the valve spring 416, to rotate reversely (i.e., counterclockwise in FIG. 4 as shown) pass a certain degree, the stop surface 414 may make contact against bottom surface of the rocker arm 404 and stop over rotation thereof, thus sufficiently limiting undesired movement of the rocker arm 404 and further preventing separation of the valve bridge 412 from corresponding engine valves.

Additionally or alternatively, the rocker arm 404 may also be provided at its bottom surface with a corresponding stopper feature 418 in a complementary manner relative to the mechanical stopper 408, so as to restrict reverse rotation of the rocker arm 404 even further. In particular embodiments, the stopper feature 418 may take form as a raised portion extending from the bottom surface of the rocker arm 404 towards the direction of the mechanical stopper 408. As an example and not by way of limitation, the stopper feature 418 may comprise a lower surface that is slightly slanted or otherwise horizontal. In the embodiment of FIGS. 4 and 5, the lower surface of the stopper feature 418 is shown as sloping upwards in a direction away from rotational axis of the rocker arm 404 such that a clearance whose height expands radially outwards is formed between the stopper feature 418 and the mechanical stopper 408 (this can be more clearly observed in FIG. 5), thereby constraining uncontrolled motion of the rocker arm 404 to a greater extent while still permitting enough room for its desired rotation during normal valvetrain operation. In other words, relative positions of the stopper feature 418 and the mechanical stopper 408 are configured in such a way that controlled rotation of the rocker arm 404 is insufficient to cause contact between the stopper feature 418 and the mechanical stopper 408. Bottom surface of the rocker arm 404 will hit against the mechanical stopper 408 only when the rocker arm 404 over rotates to a position beyond its normal motion range, that is, if critical shift occurs. Similarly, it will be appreciated that the stopper feature 418 may be configured differently than as described. For example, the stopper feature 418 may alternatively be provided by means of an individual component such as a pin, a tab, a nob, an insert, or the like that can be permanently or detachably mounted to the bottom surface of the rocker arm 404.

As shown in the cross-sectional view of FIG. 5, in particular embodiments, spacing between the bottom surface of the rocker arm 404 (e.g., the stopper feature 418) and the mechanical stopper 408 may have a distance 502 that is advantageously minimized to mitigate valve bridge separation. As an example and not by way of limitation, in one embodiment, the distance 502 is around 1.08 mm, which is determined analytically through stack-up and is limited by manufacturing tolerances. This is especially beneficial in terms of preventing valve bridge separation from engine valves that may otherwise be caused by over rotation of the rocker arm in case of critical shift.

The rocker arm 404 illustrated in FIGS. 4 and 5 may further comprise a socket 420, which is arranged at one side of the rocker arm 404 and configured for movably coupling with a terminal end of the push rod 410. In particular embodiments, the socket 420 may be designed to have an interior volume conforming to outer contour of the terminal of the push rod 410 so as to contain the terminal therein in a motion-conveying fashion (e.g., when engaged, lift of the push rod 410 may cause the rocker arm 404 to rotate). Further, the interior of the socket 420 may have a maximum socket depth 504 (shown in FIG. 5) designed to maintain overlap between the rocker arm 404 and push rod 410 in the case of a critical shift. As a non-limiting example, the socket depth 504 may approximately be 7.5 mm. Dimensioned in this way, when critical shift occurs in which the push rod 410 suddenly retracts down, separation between the rocker arm 404 and the push rod 410 may be avoided, thus protecting the overall system from malfunction.

Referring now to FIGS. 6-14, in particular embodiments, the valvetrain assembly according to this disclosure may be provided with one or more retention features in various configurations, which can be coupled or alternatively attached to the valve bridge, in order to ensure the valve bridge to be properly engaged and/or aligned with the valve tip even during a critical shift event.

Figure 6:
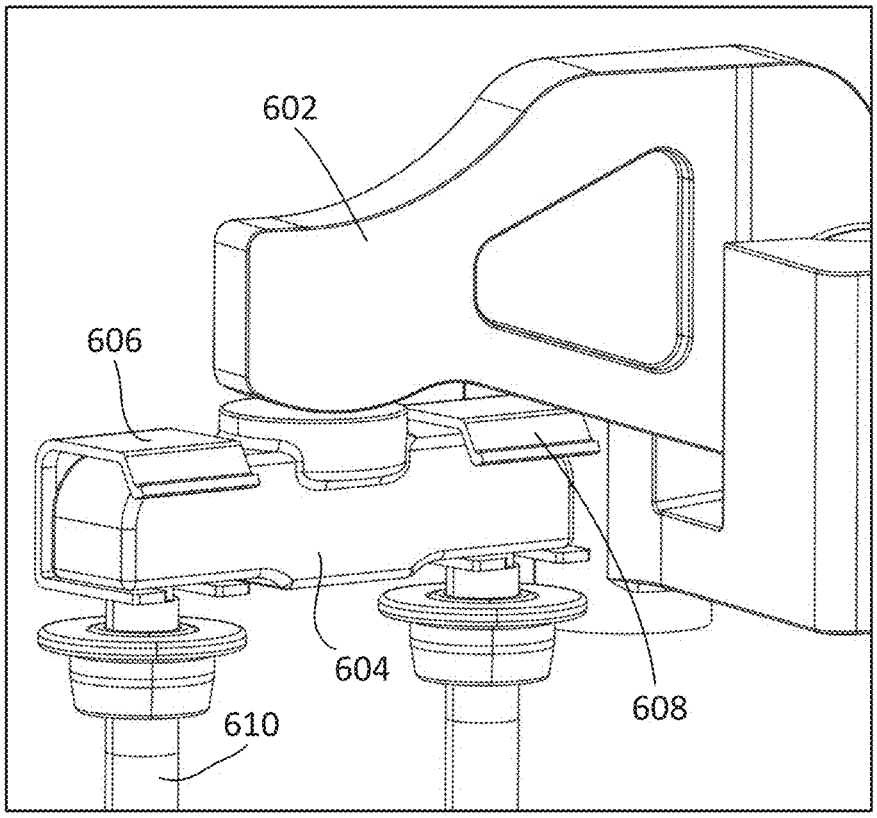
FIG. 6 depicts a partial view on portions of a valvetrain assembly according to this disclosure, specifically illustrating a first possible configuration of a retention feature associated with a valve bridge.
Figure 7:
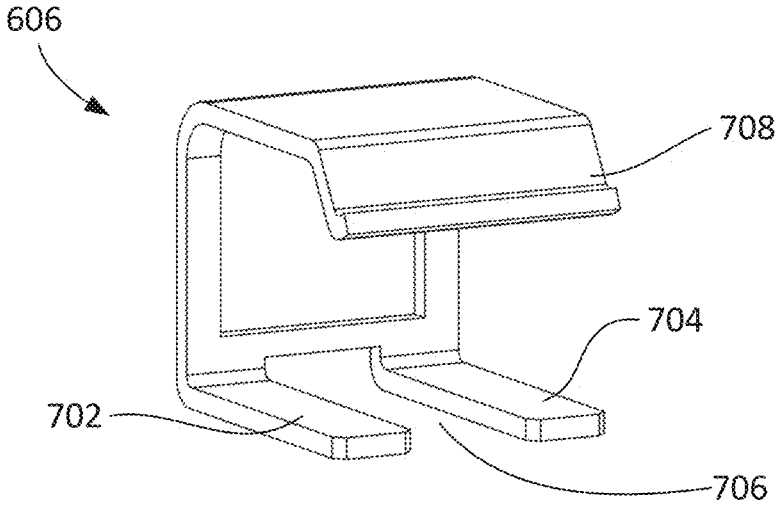
FIG. 7 depicts a stand-alone view of the first possible configuration of the retention feature in FIG. 6.

FIGS. 6 and 7 illustrate a first possible configuration of the retention feature, which is structured as a sheet metal clip 606. Though described in this particular manner, the clip may take form as alternative structures made from other suitable material or by other suitable manufacturing process as familiar to those skilled in the art for providing reliable retention. In the embodiment of FIG. 6, two sheet metal clips 606, 608 are disposed respectively around each end of a valve bridge 604 in a way to partially enclose sides of the end portion thereof. For ease of description, the following is explained with specific reference to the sheet metal clip 606 mounted to the left end of the valve bridge 604. As an non-limiting example, the sheet metal clip 606 may surround portions of bottom, back, and top surfaces of the valve bridge 604 and can be snapped in place near an edge between the top surface and the front surface of the valve bridge 604 by means of a clipping structure 708, which may be more clearly observed in FIG. 7. In addition, the sheet metal clip 606 may include, at the bottom thereof, two retention legs 702 and 704 that extend in a horizontal direction towards the front and are configured in a spaced-apart relationship relative to each other so as to provide an opening 706 therebetween. When clipped around to the valve bridge 604, the two retention legs 702 and 704 may be located underneath the bottom surface of the valve bridge 604 in such a position that the opening 706 is vertically in line with the receptacle (not shown) of the valve bridge 604 in order to provide passage for receiving terminal end of the valve 610. Put in another way, when the clip 606 and the valve bridge 604 are properly attached together, the valve 610 may extend through the opening 706 of the clip 606 into corresponding receptacle formed on the bottom surface of the valve bridge 604. In particular embodiments, width of the opening 706 (i.e., distance between the retention legs 702, 704) may be dimensioned slightly smaller than the diameter of receiving area of the receptacle. In this case where the sheet metal clip 606 is mounted correctly relative to the valve bridge 604, outer surface of the terminal end of the valve 610 may be securely gripped by the retention legs 702, 704 while avoiding contacting with interior wall of the receptacle. Optionally, to provide further securement, outer surface of the valve tip may be grooved or otherwise recessed such that when mounted, the groove formed on the tip of the valve 610 may be used to partially or completely engage with the sheet metal clip 606 (e.g., by interfacing with the retention legs 702 and 704 of the sheet metal clip 606), thereby providing additional degree of protection against separation. As a result, proper alignment of the valve bridge 604 to the engine valve 610 can be ensured, thus preventing the valve bridge 604 from slipping off from the valve end in case of a critical shift event.

Figure 8:
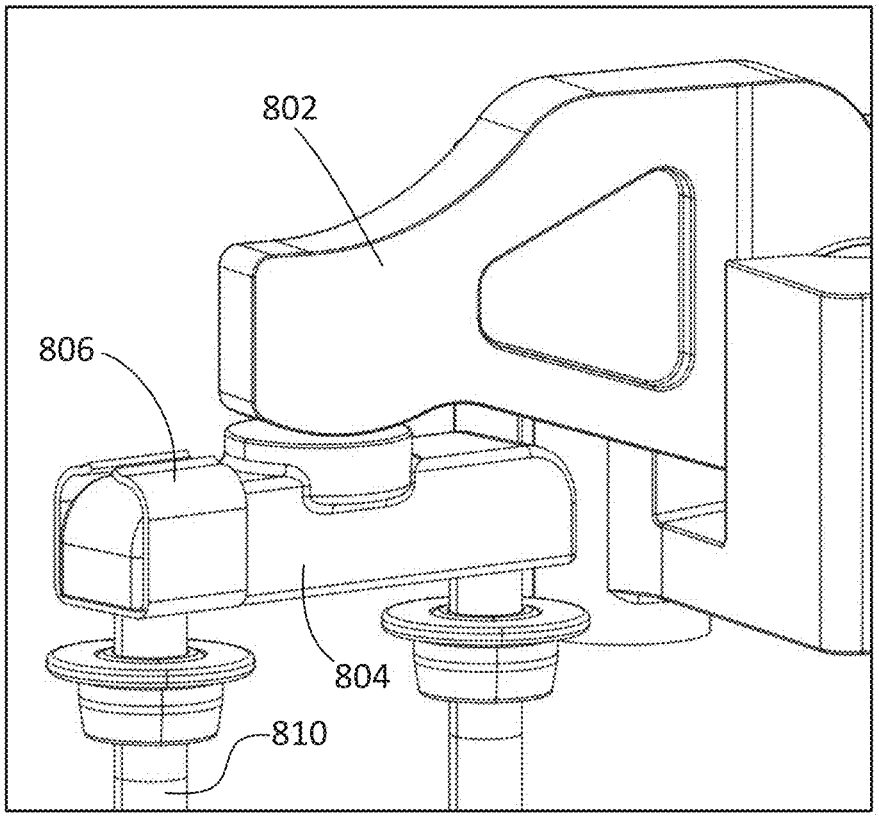
FIG. 8 depicts a partial view on portions of a valvetrain assembly according to this disclosure, specifically illustrating a second possible configuration of a retention feature associated with a valve bridge.
Figure 9:
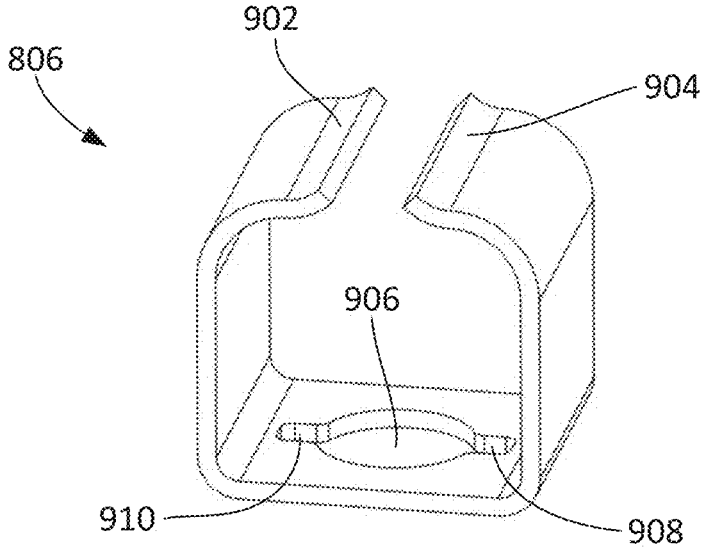
FIG. 9 depicts a stand-alone view of the second possible configuration of the retention feature in FIG. 8.

FIGS. 8-9 illustrate a second possible configuration of the retention feature, which comprises a friction clip 806. Similarly, it will be appreciated that the friction clip 806 may be configured differently than as shown for providing the desired function of this disclosure. Though shown as having one friction clip 806, the retention feature may optionally include any suitable number of clips. For example, two friction clips may be provided on both ends of the valve bridge 804 for better retention. In the embodiment illustrated, the friction clip 806 partially surrounds back, bottom, and front surfaces of the valve bridge 804 on one end thereof and may be clipped onto the top surface of the valve bridge 804 by two opposing clipping structures 902, 904. Moreover, bottom surface of the friction clip 806 is provided with a substantially circular opening 906. Similar to the opening 706 of the sheet metal clip 606 described above, when mounted in vertical alignment with the receptacle (not shown) of the valve bridge 804, the circular opening 906 may be suitable for permitting insertion of the valve tip through the friction clip 806 into the corresponding receptacle of the valve bridge 804. For facilitating retention to the valve terminal, diameter of the circular opening 906 in this case may be sized in such a way to be smaller than that of outer periphery of the valve so as to provide interference fit or friction fit with the valve tip for securely retaining the valve bridge 804 relative to the valve 810 and preventing the valve bridge 804 from slipping off the valve tip in case of a critical shift event. Additionally, circumferential side of the circular opening 808 may be optionally provided with one or more notches 908 and 910. In doing so, where the circular opening 808 is frictionally fitted around the valve tip in a secure manner, the notches 908 and 910 may help releasing stress and/or strain on the circular opening 808 caused by tight insertion of the valve tip.

Figure 10:
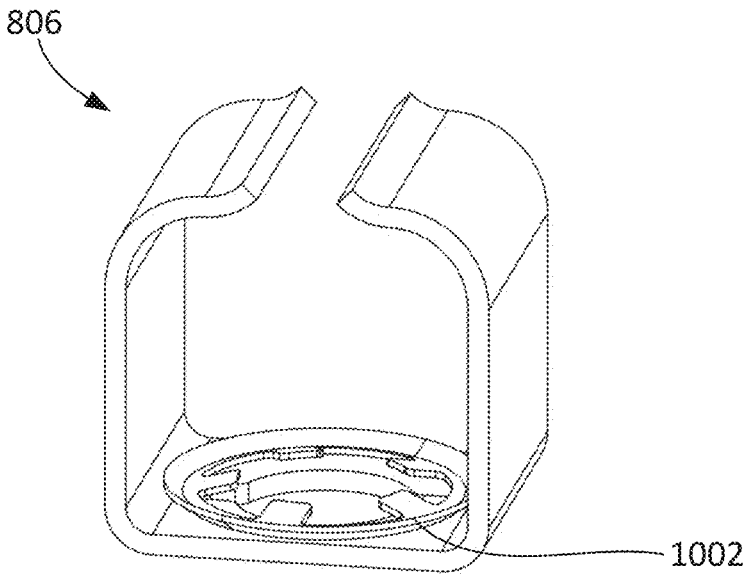
FIG. 10 depicts a variation of the second possible configuration of the retention feature.
Figure 11:
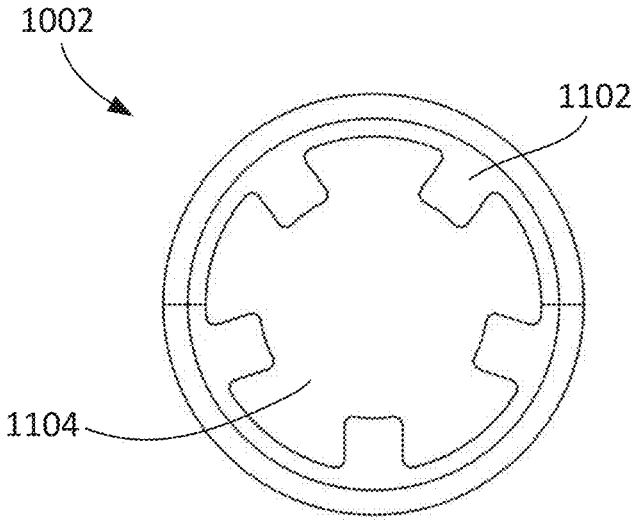
FIG. 11 depicts a top view of the variation of the second possible configuration of the retention feature in FIG. 10.

With reference to FIGS. 10-11, in addition to the friction clip 806, the retention feature may optionally comprise a collar structure, e.g., a push nut 1002, which may be placed on top of the bottom surface of the friction clip 806, such that when mounted, the push nut 1002 is sandwiched between the valve bridge 804 and the friction clip 806. As further shown, the push nut 1002 may include on its inner ring multiple retention teeth 1102 that extend horizontally toward a center and are spaced apart from each other in the circumferential direction. Together, the retention teeth 1102 may define an opening 1104 which serves similar purpose to the opening 906 of the friction clip 806, i.e., for allowing the valve tip to pass through with interference and/or under friction. Once again, the opening 1104 may have an inner diameter that is slightly smaller than the outer diameter of the valve tip so as to increase friction between the retention feature (and correspondingly the valve bridge) and the outer surface of the valve in a way to resist their relative displacement and/or separation. As a result, the push nut 1002, collectively with the friction clip 806, may serve the purpose of retaining the valve bridge in proper alignment and engagement with the engine valves.

Figure 12:
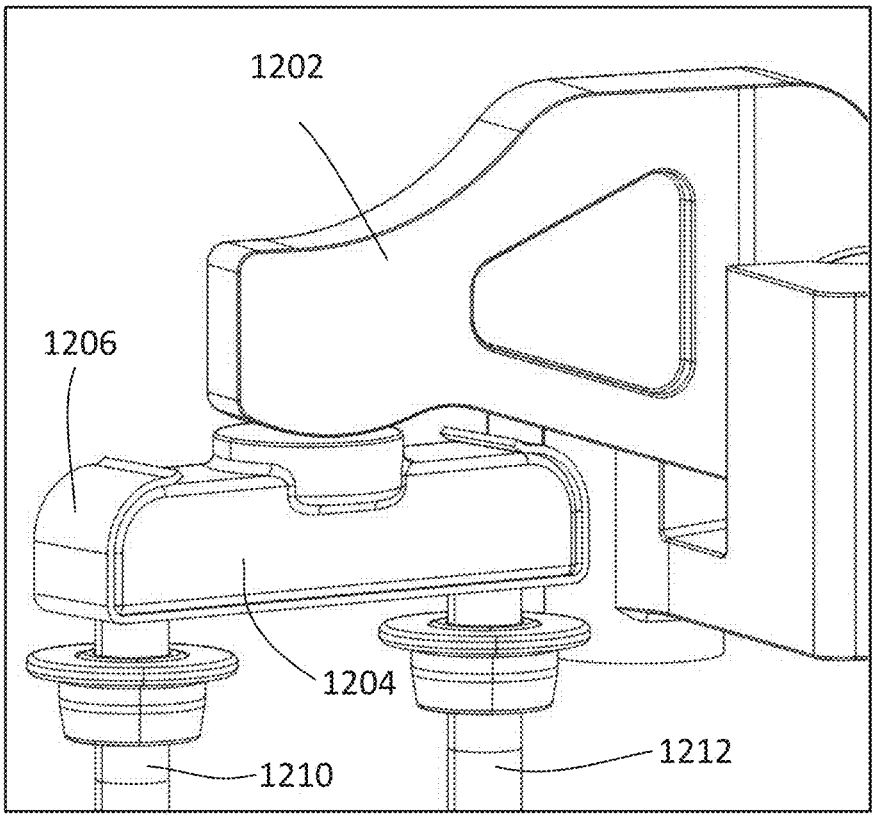
FIG. 12 depicts a partial view on portions of a valvetrain assembly according to this disclosure, specifically illustrating a third possible configuration of a retention feature associated with a valve bridge.
Figure 13:
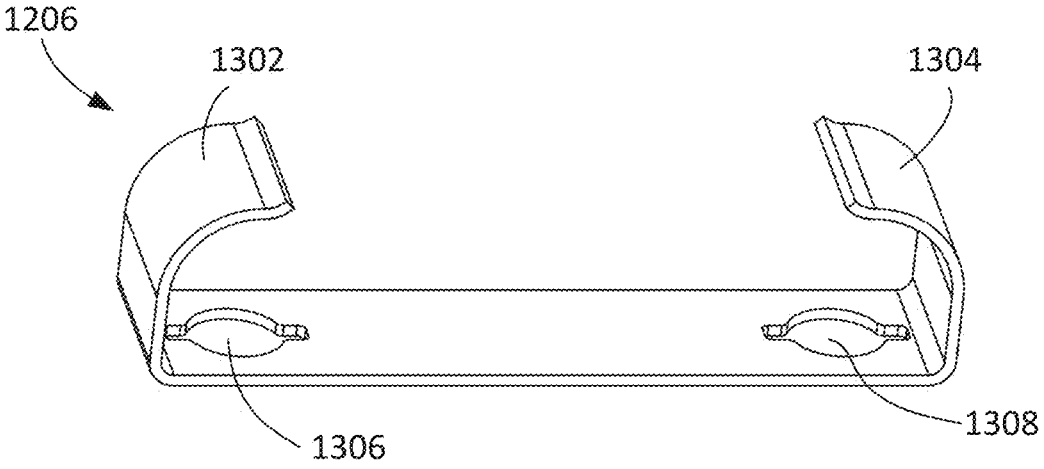
FIG. 13 depicts a stand-alone view of the third possible configuration of the retention feature in FIG. 12.

FIGS. 12-13 illustrate a third possible configuration of the retention feature, which comprises an elongated friction clip 1206 that may span the entire length of the bottom surface of the valve bridge 1204 and wrap around both left- and right-side surfaces thereof. The elongated friction clip 1206 in this configuration comprises two symmetrical clipping structures 1302 and 1304 that are similar to the clipping structure described above and may fit onto the top surface of the valve bridge 1204 at its both ends respectively. As further shown, two openings 1306 and 1308 that may be generally circular in shape are provided at the base of the elongated friction clip 1206 and positioned in a way that, when the elongated friction clip 1206 is correctly clipped around ends of the valve bridge 1204, the two openings 1306 and 1308 lie coaxially with corresponding receptacles (not shown) on the bottom portion of the valve bridge 1204. Again, the openings 1306 and 1308 may function similarly to the openings described in the embodiment of FIGS. 8-11—e.g., to tightly interface with outer surface of respective valve tip, consequently coupling the valves 1210 and 1212 with the valve bridge 1204—and may as well be provided with one or more notches to facilitate insertion of the valve tips through the openings 1306 and 1308. Although not illustrated, optional collar structure such as a push nut 1002 may further be provided on top of each of the openings 1306 and 1308 for increasing friction and enhancing retention. Configured as such, the elongated friction clip 1206 may be suitable to receive at least two respective valve tips in a secure fashion and maintain desired connection and alignment of the valve bridge 1204 with the engine valves 1210 and 1212.

Figure 14:
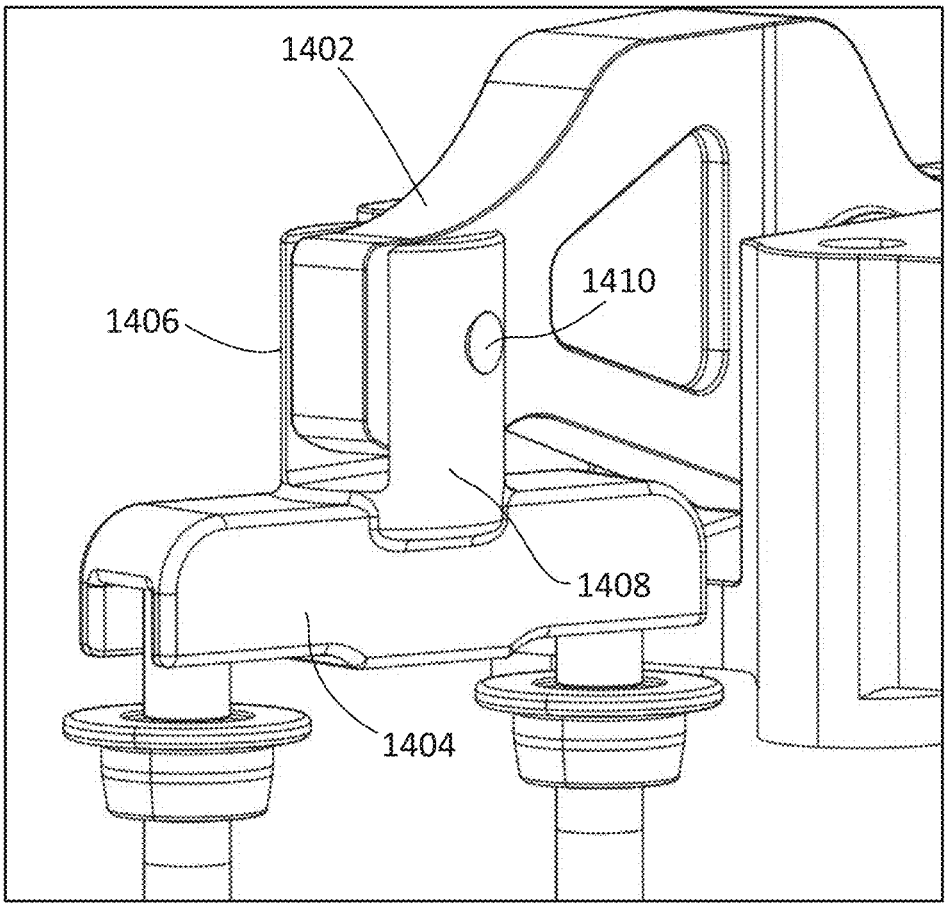
FIG. 14 depicts a partial view on portions of a valvetrain assembly according to this disclosure, specifically illustrating a fourth possible configuration of a retention feature associated with a valve bridge.

FIG. 14 illustrates a fourth possible configuration of the retention feature. Here, the retention feature may comprise one or more protrusions extending from the top surface of the valve bridge 1404 such as in the form of two side walls 1406 and 1408 as depicted. As an example and not by way of limitation, the side walls 1406 and 1408 may be integrally formed on the valve bridge 1404, or separately provided as needed. The two side walls 1406 and 1408 may be positioned in a way to form a relatively large spacing therebetween, which may in turn be used to receive a portion of the rocker arm 1402. In particular embodiments, when corresponding portion of the rocker arm 1402 is connected between the two side walls 1406 and 1408, bottom surface of such portion may rest on the top flat surface of the valve bridge 1404. Additionally, both of the side walls 1406 and 1408 as well as the portion of the rocker arm 1402 which is illustrated as being interposed in between the side walls 1406 and 1408 may be provided with a through hole or slot such that a matching insert, e.g., a pin 1410, a bolt or the like, is permitted to extend through the through hole, thereby establishing a connection between the rocker arm 1402 and the side walls 1406 and 1408 (and consequently the valve bridge 1404). Configured as such, substantial loading does not pass through the pin 1410, and the bridge motion is not restricted by the pin 1410. Undesired tilting or deflection of the valve bridge 1404 from its optimal operation position may be restricted. Moreover, radial motion of the bridge 1404 with respect to the rocker arm 1402 is restricted to an extent that when the bridge 1404 loses contact with the valves, rotation of the bridge 1404 is minimal and will allow the bridge 1404 to land back in proper position and self-align with the valve tips. It will be appreciated that, though the coupling between the valve bridge and the rocker arm is described by referencing to the side walls 1406, 1408 and the pin 1410, other suitable mechanical components (for example, a latch, a groove, a snap-fit structure, or the like associated with the valve bridge) are also envisioned by this disclosure for maintaining connection of the valve bridge with the rocker arm in a reliable manner.

The various possible configurations of the retention feature as described above are meant only as an example and not as a limitation. Certain embodiments in accordance with this disclosure may comprise none, some, or all of the above retention structures. For example, a valve bridge configured with similar structure to the embodiment described with reference to FIG. 14 which serves to connect with a rocker arm may be employed in combination with one or more clips as explained in the embodiments of FIGS. 6-13, in order to protect the valve bridge from disengaging from either the rocker arm or corresponding engine valves. It will also be understood that one or more other alternative configurations may be readily apparent to one skilled in the art in view of the figures, descriptions, and claims of this disclosure.

Moreover, as set forth above, various embodiments of components or subcomponents of the valvetrain assembly in accordance with this disclosure, whether taken alone or in different combinations with one another, may offer multiple solutions to avoid, mitigate, or at least resist valve bridge dislodgement that may happen during critical shift event, thereby maintaining proper dynamic behavior and desired motion-delivering function of the valvetrain assembly in general.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A valvetrain assembly, comprising:

a rocker arm carrier, a rocker arm rotatably supported by the rocker arm carrier, two engine valves comprising at least a first engine valve and a second engine valve, a valve bridge spanning the two engine valves and connected between the two engine valves and one end of the rocker arm, a switching mechanism operatively coupled to the rocker arm and including a first body and a second body which are configured for relative movement with respect to each other, and a retention feature is configured to be attached to the valve bridge, the retention feature connecting the valve bridge with at least one of the two engine valves, wherein the retention feature has (i) a top portion configured to at least partially enclose a top of the valve bridge and (ii) a base configured to at least partially enclose a bottom of the valve bridge, the base having an opening configured to receive and secure the at least one of the two engine valves to the retention feature, and the retention feature is further configured to maintain a position of the valve bridge to be aligned with the at least one of the two engine valves and resist separation of the valve bridge from the at least one of the two engine valves during uncontrolled valve bridge movement.

2. The valvetrain assembly of claim 1, wherein the retention feature comprises a clip which is configured to be removably attached to the valve bridge and engage with at least the first engine valve of the two engine valves.

3. The valvetrain assembly of claim 2, wherein the clip comprises at least one opening which is arranged at a base of the clip and configured to allow an end portion of at least the first engine valve to be inserted through the opening.

4. The valvetrain assembly of claim 3, wherein the at least one opening has an inner diameter which is dimensioned such that the end portion of the first engine valve, when inserted through the at least one opening, forms friction fit with the retention feature.

5. The valvetrain assembly of claim 3, wherein the retention feature further comprises a push nut which is configured to be positioned on top of the at least one opening.

6. The valvetrain assembly of claim 3, wherein the clip comprises two openings which are arranged at opposite ends of the base of the clip and configured to allow end portions of the first engine valve and the second engine valve to be respectively inserted through the two openings.

7. The valvetrain assembly of claim 2, wherein the clip comprises at least two retention legs which are configured to hold an end portion of at least the first engine valve therebetween.

8. The valvetrain assembly of claim 1, wherein the retention feature comprises at least two protrusions formed on a top surface of the valve bridge, the at least two protrusions being configured to define a spacing therebetween suitable for receiving at least a portion of the rocker arm.

9. The valvetrain assembly of claim 8, wherein the retention feature further comprises a pin that is configured to extend through the at least two protrusions and the portion of the rocker arm such that the valve bridge is rotatably connected to the rocker arm.

10. The valvetrain assembly of claim 1, further comprising a mechanical stopper which is disposed on an upper surface of the rocker arm carrier and configured to contact against a lower surface of the rocker arm during uncontrolled valve bridge movement.

11. The valvetrain assembly of claim 10, wherein the mechanical stopper is configured to protrude from the upper surface of the rocker arm carrier towards the lower surface of the rocker arm.

12. The valvetrain assembly of claim 10, wherein the mechanical stopper is formed integrally with the rocker arm carrier.

13. The valvetrain assembly of claim 10, further comprising a stopper feature which is disposed on the lower surface of the rocker arm and configured to contact against the mechanical stopper during uncontrolled valve bridge movement.

14. The valvetrain assembly of claim 1, further comprising a spring which is configured to be connected to the switching mechanism and damp relative movement between the first body and the second body of the switching mechanism, the spring having a stiffness and a preload that prevent the valve bridge from separating from the two engine valves during uncontrolled valve bridge movement.

15. The valvetrain assembly of claim 14, further comprising a gap which is positioned between the first body and the second body of the switching mechanism and configured to define landing of the second body with respective to the first body.

16. The valvetrain assembly of claim 15, further comprising at least two receptacles positioned on a lower surface of the valve bridge and configured to respectively receive at least a portion of the two engine valves, the at least two receptacles having a depth that prevents the valve bridge from separating from the two engine valves during uncontrolled valve bridge movement.

17. The valvetrain assembly of claim 16, further comprising a socket positioned on a lower surface at another end of the rocker arm and configured to receive a push rod, the socket having a depth that prevents the push rod from separating from the socket during uncontrolled valve bridge movement.

18. A valvetrain assembly, comprising:

a rocker arm carrier, a rocker arm rotatably supported by the rocker arm carrier, two engine valves comprising at least a first engine valve and a second engine valve, a valve bridge spanning the two engine valves and connected between the two engine valves and one end of the rocker arm, a switching mechanism operatively coupled to the rocker arm and including a first body and a second body which are configured for relative movement with respect to each other, and a retention feature, wherein the retention feature comprises one or more protrusions on a top surface of the valve bridge, the one or more protrusions attach the valve bridge to the rocker arm, and wherein the retention feature is configured to maintain a position of the valve bridge to be aligned with the two engine valves and resist separation of the valve bridge from the two engine valves during uncontrolled valve bridge movement.

19. The valvetrain assembly of claim 18, wherein the retention feature further comprises a pin that is configured to extend through the one or more protrusions and a portion of the rocker arm such that the valve bridge is rotatably connected to the rocker arm.

20. A valvetrain assembly, comprising:

a rocker arm carrier, a rocker arm rotatably supported by the rocker arm carrier, two engine valves comprising at least a first engine valve and a second engine valve, a valve bridge spanning the two engine valves and connected between the two engine valves and one end of the rocker arm, a switching mechanism operatively coupled to the rocker arm and including a first body and a second body which are configured for relative movement with respect to each other, a socket positioned on a lower surface at another end of the rocker arm and configured to receive a push rod, the socket having a depth that prevents the push rod from separating from the socket during uncontrolled valve bridge movement, and a mechanical stopper which is disposed on an upper surface of the rocker arm carrier and configured to contact against a lower surface of the rocker arm during uncontrolled valve bridge movement, wherein the socket and the mechanical stopper are configured to limit motion of the rocker arm and prevent the valve bridge from separating from the two engine valves during uncontrolled valve bridge movement.

* * * * *